US007753738B2

(12) United States Patent
Zhang

(10) Patent No.: US 7,753,738 B2
(45) Date of Patent: Jul. 13, 2010

(54) ELECTRICAL CONNECTOR WITH AN ANTI-DUST DEVICE TO AVOID THE POOR CONTACT FROM DUST

(75) Inventor: Han-Ming Zhang, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 201 days.

(21) Appl. No.: 12/157,657

(22) Filed: Jun. 11, 2008

(65) Prior Publication Data

US 2008/0305667 A1 Dec. 11, 2008

(30) Foreign Application Priority Data

Jun. 11, 2007 (CN) ..... 2007 2 0039789

(51) Int. Cl.
*H01R 24/04* (2006.01)

(52) U.S. Cl. ..... 439/668; 439/519

(58) Field of Classification Search ..... 439/668, 439/669, 519

See application file for complete search history.

(56) References Cited

U.S. PATENT DOCUMENTS 7,637,787 B2 * 12/2009 Chien et al. ..... 439/668
7,645,170 B2 * 1/2010 Long et al. ..... 439/668
2002/0052149 A1 * 5/2002 Suzuki et al. ..... 439/668
2008/0280499 A1 * 11/2008 Miki et al. ..... 439/668
2008/0299835 A1 * 12/2008 Lin et al. ..... 439/668
2008/0305667 A1 * 12/2008 Zhang ..... 439/271
2009/0149080 A1 * 6/2009 Wu ..... 439/668
2009/0149081 A1 * 6/2009 Zhu et al. ..... 439/668
2009/0176414 A1 * 7/2009 Chien et al. ..... 439/668
2009/0275245 A1 * 11/2009 Zhang et al. ..... 439/701

* cited by examiner

*Primary Examiner*—Ross N Gushi
(74) *Attorney, Agent, or Firm*—Ming Chieh Chang; Wei Te Chung; Andrew C. Cheng

(57) ABSTRACT

An audio jack comprises a set of contacts including a stationary contact (25) and a movable contact (23), and an anti-dust dome member (5). The anti-dust dome member (5) includes a conductive sheet (51) extending from a horizontal plate portion (250) of the stationary contact (25) to a lateral beam (235) of the movable contact (23), and a middle conductive dome sheet (52) below the conductive sheet (51). The conductive dome sheet (52) is constantly actuated to establish an electrical connection between the stationary contact (25) and the movable contact (23). Thus, even if dust is deposited on the anti-dust dome member (5) will have no effect on the electrical connection as established.

12 Claims, 5 Drawing Sheets

ELECTRICAL CONNECTOR WITH AN ANTI-DUST DEVICE TO AVOID THE POOR CONTACT FROM DUST

BACKGROUND OF THE INVENTION

1. Field of the Invention

The present invention relates to electrical connectors, especially to an electrical connector with an anti-dust device to avoid the poor contact between the movable contact and the fix contact due to dust contamination.

2. Background of the Invention

With the ever-increasing miniaturization of computer and other electronic equipment, it becomes increasingly difficult to design electrical circuitry for connector thereof. One area of such difficulty is electrical switches or switch assemblies. An electrical switch assembly may be used as a normally open switch with switch contacts designed to be closed upon actuating the switch, or the switch assembly may be a normally closed switch with the contacts designed to be opened when the switch is actuated.

U.S. Pat. No. 4,937,404 issued to Kitagawa on Jun. 26, 1990 discloses an electrical connector comprising an insulative housing and a plurality of contacts, the insulative housing has an observation window, the contacts including signal contacts and switch contacts, the switch contacts including a first movable contact, a second movable contact; a first fix contact and a second fix contact are also included which act in concert with the first movable contact and the second movable contact. The first movable contact has a first elastic portion and a first contact portion extending from the first elastic portion. The first contact portion straps on the first fix contact to form a conductive circuit.

Unfortunately, problems continue to be encountered with the electrical connectors mentioned above. The observation window is helpful to examine the connection between the first contact portion and the first fix contact. However, the dust is easy to get into the observation window and make the first contact portion fail to connect with the first fix contact. Therefore, an improved electrical connector is desired to overcome the disadvantages of the prior arts.

SUMMARY OF THE INVENTION

An object, therefore, of the invention is to provide a new and improved electrical connector of the character able to prevent a poor electrical connection between contacts due to the dust contamination.

In order to achieve the objects set forth above, an audio jack for receiving a mating plug according to a preferred embodiment comprises an insulative housing defining a longitudinal plug-insertion hole, a set of contacts assembled on to the insulative housing and including a stationary contact and a movable contact. The stationary contact defines a plate portion. The movable contact has a lateral beam located proximate to the plate portion. An anti-dust dome member is disposed between the stationary contact and the movable contact. The anti-dust dome member includes a first insulative sheet attached onto the plate portion and defining an opening, a middle conductive dome sheet shaped to cover the opening of the first insulative sheet, and a second conductive sheet adhesively disposed on the first insulative sheet to cover the middle conductive dome sheet and to contact the lateral beam of the movable contact, wherein the first insulative sheet is configured to isolate an electrical connection between the second conductive sheet and the stationary contact. The middle conductive dome sheet is constantly actuated to establish an electrical connection between the second conductive sheet and the plate portion of the stationary contact. In this preferred embodiment, due to having the extension of the second conductive sheet from the plate portion to the lateral beam of the movable contact, the electrical connection between the second conductive sheet and the plate portion of the stationary contact will indirectly result in an electrical connection of the stationary contact and the movable contact. Thus, even if dust is deposited on the anti-dust dome member will have no effect on the electrical connection between the stationary contact and the movable contact, because the anti-dust dome member is constantly actuated having no influence of the dust deposition.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
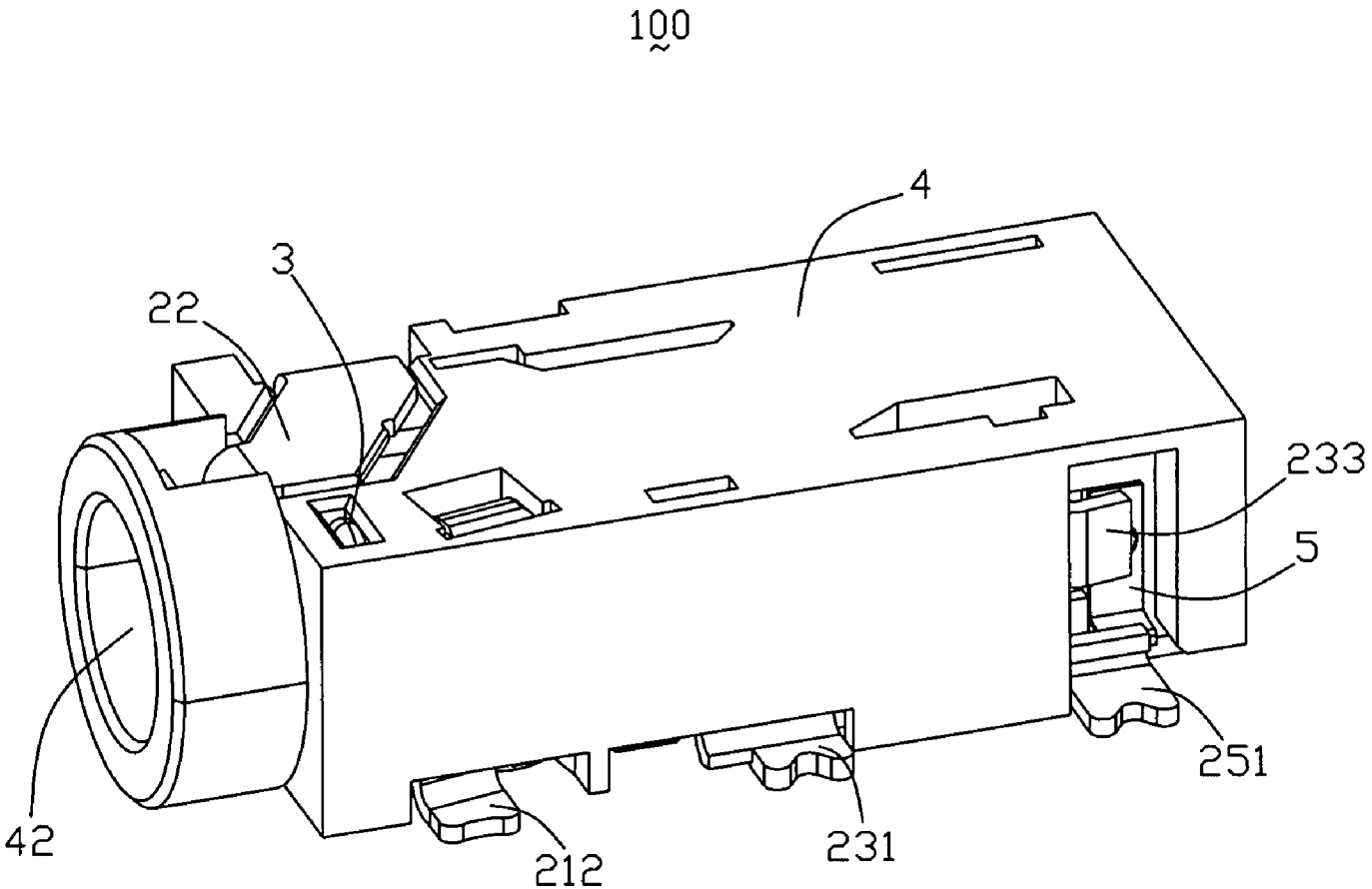
FIG. 1 is an assembled, perspective view of an electrical connector embodying the concepts of the invention.

Referring to FIG. 1, an electrical connector 100 includes an insulative housing 4, a plurality of contacts, a retention device 3 and an anti-dust device or dome member 5.

Figure 2:
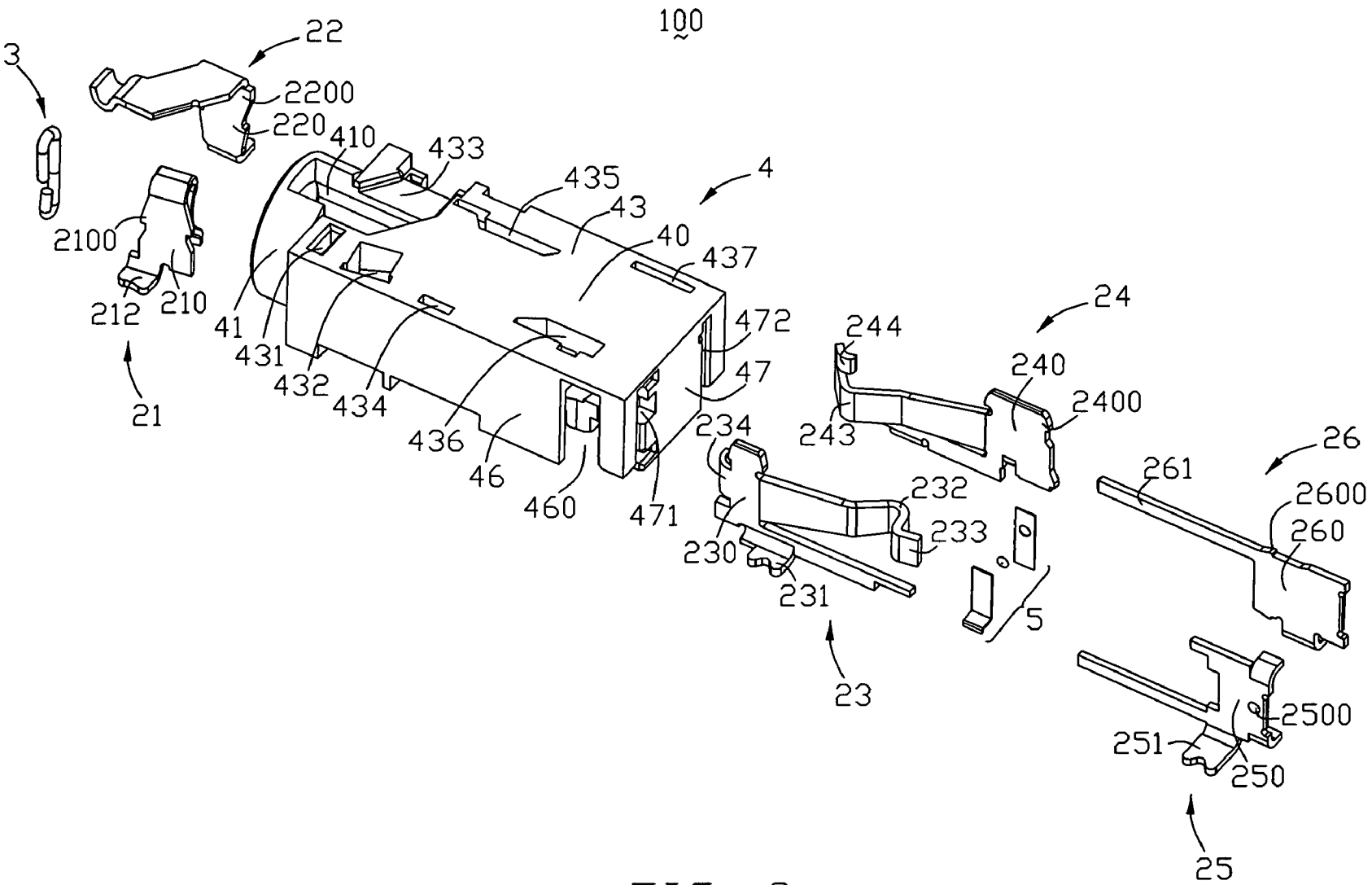
FIG. 2 is an exploded, perspective view of the electrical connector shown in FIG. 1.

Referring to FIG. 2, contacts includes a signal contact and a switch contact, the signal contact has a first signal contact 21 and a second signal contact 22; the switch contact has a first movable contact 23, a second movable contact 24, a first fix or stationary contact 25 and a second fix or stationary contact 26, the first fix contact 25 and second fix contact 26 coordinate with the first movable contact 23 and second movable contact 24 respectively.

Figure 3:
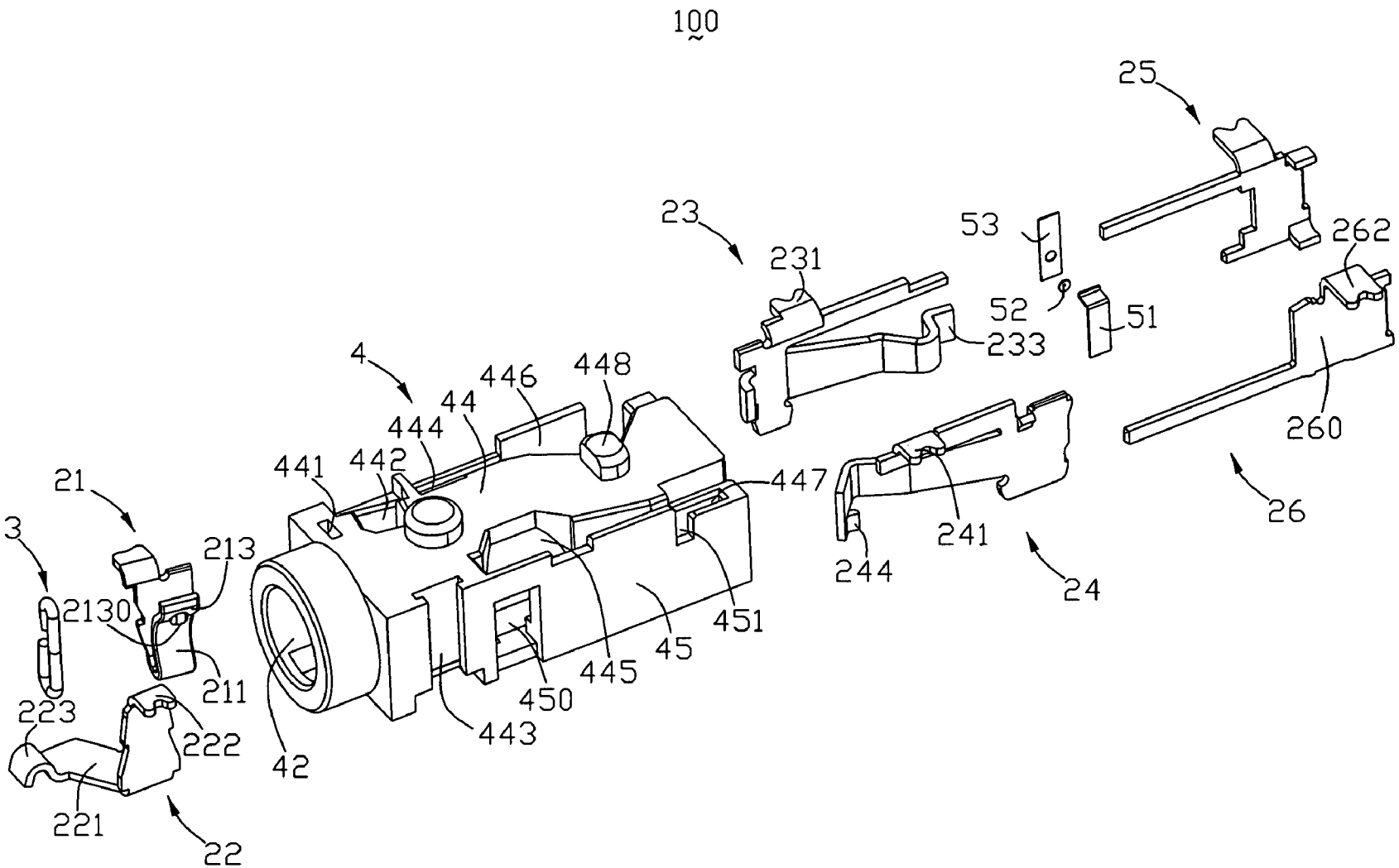
FIG. 3 is another exploded, perspective view of the electrical connector shown in FIG. 1.

Referring to FIGS. 2 and 3, the first signal contact 21 has a first block portion 210, a first arm portion 211 and a first soldering portion 212 extending from two ends of the first block portion 210, the first arm portion 211 extends from the free end and forms a first contact portion 213, first thorn portions 2100 are formed on two sides of the first block portion 210, the first contact portion 213 has a dimple 2130 on the surface.

The second signal contact 22 has a second block portion 220, a second arm portion 221 and a second soldering portion 222 extending from two ends of the second block portion 220. The second arm portion 221 extends from the free end and forms a second contact portion 223, the second thorn portions 2200 are formed on two sides of the second block portion 220.

The first movable contact 23 includes a first retention portion 230, and a third soldering portion 231 extending from the end of the first retention portion 230. A first elastic portion 232 and an interfering portion 234 are formed on two sides of the first retention portion 230 respectively. A third contact portion 233 extends from the end of the first elastic portion 232.

The second movable contact 24 includes a second retention portion 240 and a fourth soldering portion 241 extending from the second retention portion 240, the second retention portion 240 has a fourth thorn portion 2400 on two sides thereof. A second elastic portion 243 is formed on one side's middle part of the second retention portion 240. The end of second elastic portion 243 extends and forms a fourth contact portion 244.

The first fix contact 25 sticks to the first movable contact 23 firmly and includes a first base or a plate portion 250 and a fifth soldering portion 251, the fifth soldering portion 251 extending from one side of the first base portion 250. A dust-proof portion 5 of the elastic slice 52 is set at the part where the third contact portion 233 of the first movable contact 23 strap on the first base portion 250 of the first fix contact 25. The fifth thorn portion 2500 is formed on the first base portion 250.

The second fix contact 26 includes a second base portion 260, a sixth contact portion 261 extending from the second base portion 260 and a sixth soldering portion 262 extending from one side of the second base portion 260. The sixth contact portion 261 sticks to the fourth contact portion 244 of the second movable contact 24. A sixth thorn portion 2600 is set on the top of the second base portion 260.

The retention device 3 has a nick which is helpful to the plug's retention after inserting into the electrical connector 100.

The insulative housing 4 includes a main body 40; a joint portion 41 protruding from one side of the main body 40; and a patch hole 42 running through the main body 40 and the joint portion 41. The main body portion 40 includes a top wall 43, a bottom wall 44, a first side wall 45, a second side wall 46 and a back wall 47, the top of the joint portion 41 has a nick portion 410 which connects the patch hole 42.

The first side wall 45 and the second side wall 46 have a first opening 450 and a second opening 460. A lock opening 451 is formed on the first side wall 45 near the back wall 47; the back wall 47 has the first groove 471 and the second groove 472.

The top wall 43 includes a first passageway 431, a second passageway 432, a third passageway 433, a fourth passageway 434, a fifth passageway 435, a sixth passageway 436 and a seventh passageway 437. The third passageway 433, the fifth passageway 435 and the seventh passageway 437 are set along the side near the first sidewall 45. The first passageway 431, the second passageway 432, the fourth passageway 434 and the sixth passageway are set along the side near the second sidewall 46.

The bottom wall 44 includes a first groove portion 441, a second groove portion 442, a third groove portion 443, a fourth groove portion 444, a fifth groove portion 445, a sixth groove portion 446 and a seven groove portion 447, which are corresponding to the top wall 43.

Figure 4:
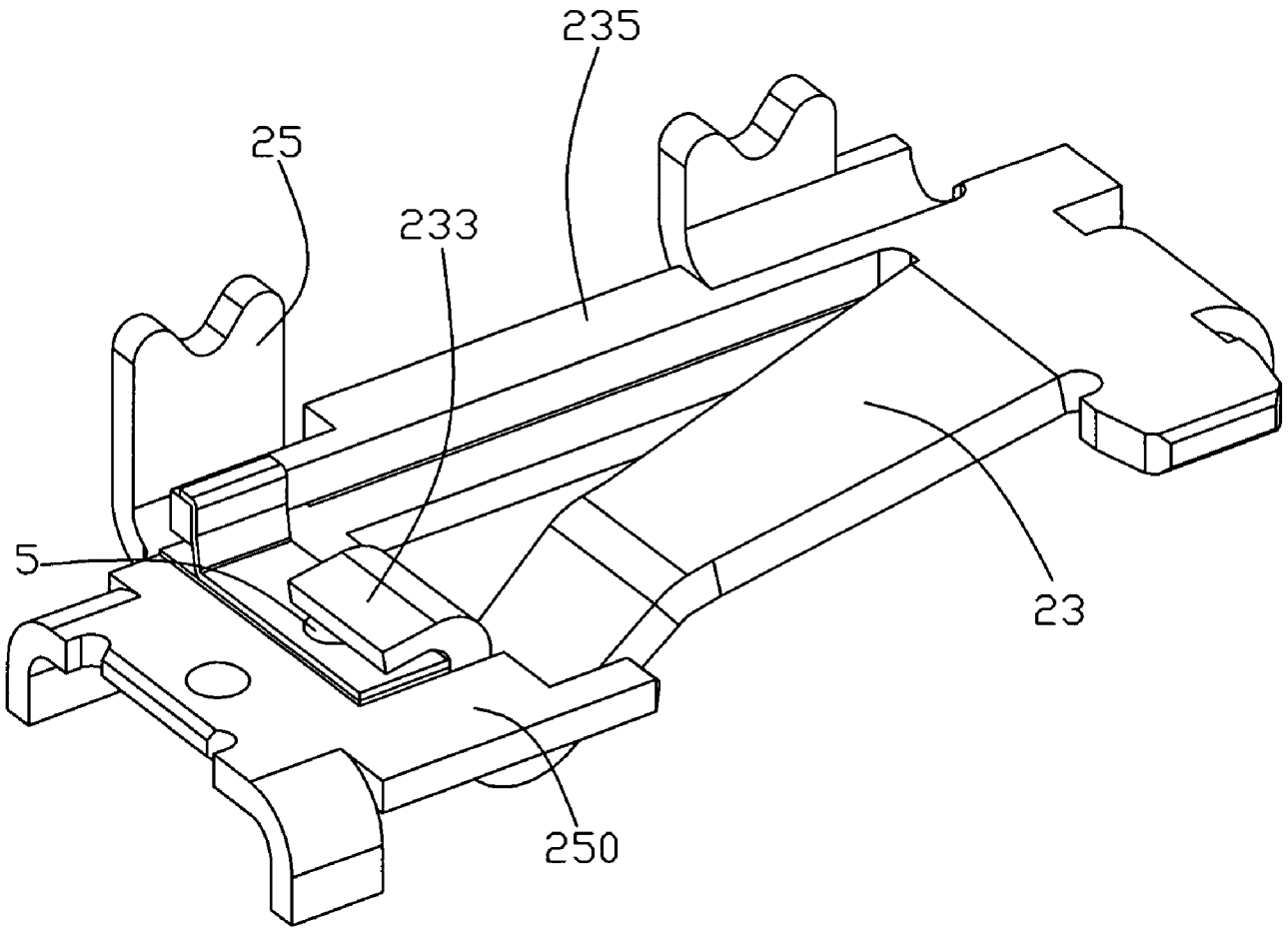
FIG. 4 is a perspective view showing a stationary contact electrically connected with a movable contact by an anti-dust dome member.
Figure 5:
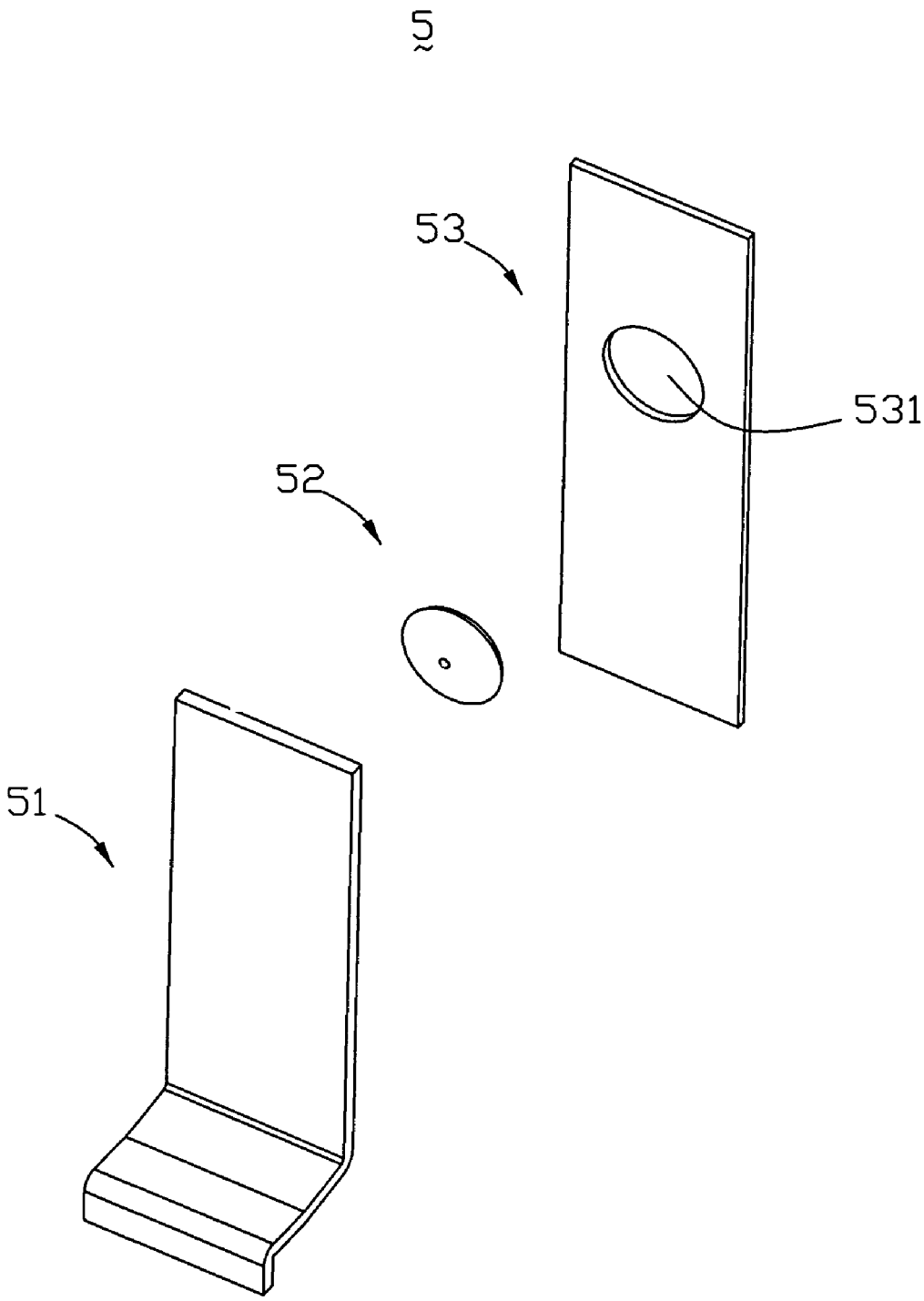
FIG. 5 is an exploded, perspective view of the anti-dust dome member of the electrical connector shown in FIG. 1.

Referring to FIG. 4, the stable or first fix contact 25 defines the plate portion 250. The movable contact 23 has a lateral beam 235 located proximate to the plate portion 250. The anti-dust dome member 5 is attached between the stationary contact 25 and the movable contact 23. Referring to FIG. 5, the anti-dust dome member 5 includes a first insulative sheet 53, a second conductive sheet 51 and a middle conductive dome sheet 52. The first insulative sheet 53 is attached onto the plate portion 250 and defining an opening 531. The middle conductive dome sheet 52 is shaped to cover the opening 531 of the first insulative sheet 53. The second conductive sheet 51 is adhesively disposed on the first insulative sheet 53 to cover the middle conductive dome sheet 52 and to contact the lateral beam 235 of the movable contact 23, wherein the first insulative sheet 53 is configured to isolate an electrical connection between the second conductive sheet 51 and the stationary contact 25. As shown in FIGS. 4 and 5, the middle conductive dome sheet 52 is constantly actuated by an elastic force, which is generated by an elastic arm 233 of an actuating element in its normal state, to enable an electrical contact between the second conductive sheet 51 and the plate portion 250 of the stationary contact 25 via the middle conductive dome sheet 52 on the opening 531 of the first insulative sheet 53, which indirectly results in an electrical connection of the stationary contact 25 and the movable contact 23 due to having the extension of the second conductive sheet 51 from the plate portion 250 to the lateral beam 235 of the movable contact 23. In this preferred embodiment, the elastic arm 233 of the actuating element is part of the movable contact 23. Thus, even if dust is deposited on a joint of the anti-dust dome member 5 and the elastic arm 233 of the actuating element will have no effect on the electrical connection between the stationary contact 25 and the movable contact 23, which is indirectly and constantly actuated by the elastic force from the actuating element, that is exerted on the an anti-dust dome member 5. This will avoid the poor electrical connection between the stationary contact 25 and the movable contact 23 due to the influence of dust. In addition, when the elastic arm 233 of the movable contact 23 is at a second state where a complementary plug is inserted into the electrical connector to urge said elastic arm 233 away from said middle conductive dome sheet 52, the middle conductive dome sheet 52 is no longer actuated to enable the electrical connection between the stationary contact 25 and the movable contact 23 due to having the middle conductive dome sheet 52 left away from the stationary contact 25 and no longer electrically contacting the stationary contact 25.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

While preferred embodiment in accordance with the present invention have been shown and described, equivalent modifications and changes known to persons skilled in the art according to the spirit of the present invention are considered within the scope of the present invention as defined in the appended claims.

What is claimed is:

1. An audio jack for receiving a mating plug, comprising:

an insulative housing defining a longitudinal plug-insertion hole;

a set of contacts assembled to the insulative housing and including a stationary contact and a movable contact, the stationary contact defining a plate portion, the movable contact having a lateral beam located proximate to the plate portion; and an anti-dust dome member disposed between the stationary contact and the movable contact, said anti-dust dome member including a first insulative sheet attached onto the plate portion and defining an opening, a middle conductive dome sheet shaped to cover the opening of the first insulative sheet, and a second conductive sheet attached on the first insulative sheet to cover the middle conductive dome sheet and contacting the lateral beam of the movable contact, wherein the first insulative sheet is configured to isolate an electrical connection between the second conductive sheet and the stationary contact;

wherein said middle conductive dome sheet is constantly actuated to establish an electrical connection between the second conductive sheet and the plate portion of the stationary contact.

2. The audio jack of claim 1, wherein the movable contact comprises an elastic arm for constantly actuating the second conductive sheet and therefore the middle conductive dome sheet.

3. The audio jack of claim 2, wherein the elastic arm of the movable contact at its normal state constantly actuates the middle conductive dome sheet.

4. The audio jack of claim 2, wherein said middle conductive dome sheet is no longer actuated by said elastic arm when a complementary plug is inserted into the electrical connector to urge said elastic arm away from said middle conductive dome sheet.

5. An electrical connector comprising:

an insulative housing defining a mating port;

a stationary contact and a deflectable contact respectively disposed in the housing, said deflectable contact defining a section extending into the mating port for being actuated by a plug which is inserted into the mating port;

a deformable dome located above the stationary contact and essentially isolated from the stationary contact via an insulator when said dome is not deformed by the deflectable contact due to insertion of the plug, while being mechanically and electrically connected to the stationary contact when said dome is deformed by said deflectable contact without any plug being inserted into the mating port; wherein the gap between the dome and the stationary contact is essentially sealed without communication with an exterior.

6. The connector as claimed in claim 5, wherein a conductive member is constantly associated with said deformable dome disregarding whether said dome is deformed or not.

7. The connector as claimed in claim 5, wherein the dome is deformed directly by said deflectable contact.

8. The connector as claimed in claim 6, wherein said conductive member is constantly electrically connected to the deflectable contact.

9. The connector as claimed in claim 5, wherein said insulator defines a hole through which the deformed dome extends.

10. An electrical connector comprising:

an insulative housing defining a mating port;

a stationary contact and a deflectable piece respectively disposed in the housing, said deflectable contact defining a section extending into the mating port for being actuated by a plug which is inserted into the mating port;

a deformable dome located above the stationary contact and essentially isolated from the stationary contact via an insulator when said dome is not deformed by the deflectable contact due to insertion of the plug, while being mechanically and electrically connected to the stationary contact when said dome is deformed by said deflectable contact without any plug being inserted into the mating port; wherein the gap between the dome and the stationary contact is essentially sealed without communication with an exterior; wherein a conductive member is constantly associated with said deformable dome disregarding whether said dome is deformed or not, and said conductive member is constantly electrically connected, and said conductive member is constantly electrically connected to another contact.

11. The connector as claimed in claim 10, wherein said deflectable piece and said another contact are the same one.

12. The connector as claimed in claim 10, wherein said insulator defines a hole through which the deformed dome extends.

* * * * *